United States Patent [19]

Kannegiesser et al.

[11] 3,961,733

[45] June 8, 1976

[54] DEVICE FOR PRESSING ARTICLES OF CLOTHING

[75] Inventors: Martin Kannegiesser, Bad Salzuflen; Richard Juraschek, Vlotho, Weser, both of Germany

[73] Assignee: Herbert Kannegiesser Kommanditgesellschaft, Voltho, Weser, Germany

[22] Filed: Mar. 26, 1975

[21] Appl. No.: 562,275

[30] Foreign Application Priority Data

Mar. 27, 1974 Germany ..... 2414702

[52] U.S. Cl. ..... 223/57

[51] Int. Cl.[2] ..... D06C 15/00

[58] Field of Search ..... 223/57, 67, 70, 72, 223/73, 74; 38/15, 16, 17, 22

[56] References Cited

UNITED STATES PATENTS

| | | | |
|---|---|---|---|
| 2,698,705 | 1/1955 | Hitz | 223/57 |
| 2,743,854 | 5/1956 | Strike | 223/57 |
| 3,613,969 | 10/1971 | Forse | 223/57 |

*Primary Examiner*—George V. Larkin

*Attorney, Agent, or Firm*—Sughrue, Rothwell, Mion, Zinn & Macpeak

[57] ABSTRACT

A device is disclosed for pressing articles of clothing, more particularly for pressing the body portions of shirts and work uniforms, wherein an inflatable, molded buck is mounted on a support, and the assembly is movable into a position between a pair of heated pressing plates. Movable supporting and spreading elements are attached to the support and located within the inflatable buck, the supporting and spreading elements being movable to ensure that the inflatable buck fully supports the article to be pressed in the area of the shoulders and side portions of the article. After the movable supporting and spreading elements are adjusted, the buck is inflated so as to ensure that all portions of the article to be pressed are, in fact, pressed by the heated pressing plates.

9 Claims, 5 Drawing Figures

DEVICE FOR PRESSING ARTICLES OF CLOTHING

BACKGROUND OF THE INVENTION

1. Field of the Invention

The present invention relates to a device for pressing articles of clothing, more particularly, for pressing the body parts of shirts and work uniforms, wherein a molded body mounted over a support and consisting of an inflatable buck made of a pressure medium-resistant material is adapted to be advanced and retracted between heated pressing plates.

2. Description of the Prior Art

In the case of a known device of the above-mentioned type (German AS No. 1,137,413) which is designed for pressing shirts, in particular, the shirt to be pressed is pulled onto an inflated buck provided with arm parts. The body portion and the arm parts of the inflated buck conform generally to the shape of the shirt to be pressed and are provided with known supporting means which enable the shirt to be pressed to be pulled onto the inflated buck when it is not inflated or when it is only slightly inflated.

In addition, to make it easier to pull the shirt to be pressed onto the inflated buck, the arm parts of the inflatable buck are hingedly mounted on the support for the inflatable buck. A disadvantage of this device is that it cannot be used for pressing waist-fitting articles of clothing which are fastened — possibly by means of buttons. This is due, in particular, to the fact that, firstly, these articles of clothing cannot be pulled onto the inflated buck — or at least not properly — when the inflatable buck is uninflated or only partially inflated, and, secondly, the contour of the shoulders and/or side parts of the article of clothing is not drawn according to the cut of the article. If the shirt is not stretched according to the cut, it cannot be pressed correctly. This is especially true of the region of the side parts and the shoulders which extends from the waist to the part of the shoulder supported on the shirt support.

One of the reasons for the shirt not being stretched according to its cut and for the imperfect pressing of the shoulders and side parts is that the shirt to be pressed is stretched as a result of the inflatable buck being inflated.

It is also known (U.S. Pat. No. 2,698,705) to incorporate in the arm parts of an inflatable buck, elements which are secured to the shirt support and by means of which the arm parts can be stretched in their longitudinal direction.

Some of the known devices also have the disadvantage that the dimensions of the inflatable buck and the support over which it is mounted are such as to prevent shirts of different sizes from being pressed on the same molded body.

If articles other than shirts, such as work uniforms, are being pressed, the known devices are provided with inflatable covers which are adapted to the shape of these articles of clothing. All in all, these inflatable covers can only be designated as inflatable bucks. For this reason, to simplify matters, these inflatable covers will henceforth be designated as inflatable bucks.

SUMMARY OF THE INVENTION

The object of the present invention is to provide a device of the type described initially which enables fastened, waist-fitting articles of clothing of different sizes to be pulled onto the molded body of the device and which enables the shoulders and side parts of these articles of clothing to be correctly pressed. The device according to the invention should also be relatively free of breakdowns and have a lower air consumption than the known devices.

The device according to the invention is characterized in that controllably movable supporting and spreading elements for adapting the contours of the shoulders and/or side parts of the inflatable buck to the contours of the article to be pressed are disposed inside the inflatable buck.

By virtue of this configuration of the device it is possible for fastened, waist-fitting articles of clothing of different sizes to be readily pulled onto the molded body of the device and for them to be firstly stretched according to their cut and then fully stretched, thus enabling the shoulders and side parts of these articles to be pressed in a satisfactory manner.

It is an advantage if, firstly, the controllably movable supporting and spreading elements are mounted so as to be advanceable and retractable between the walls of the support on which the inflatable buck is mounted such that in the retracted state (normal position), they are inserted as far as possible within the support and, secondly, if the supporting elements for adapting the contours of the shoulders of the inflatable buck to those of the article of clothing to be pressed are provided with double walls and if the spreading elements for adapting the contours of the side parts of the inflatable buck to those of the article to be pressed are designed to be advanced and retracted at least partially between the walls of the double-walled supporting elements.

This disposition and configuration of the supporting and spreading elements is an advantage, inter alia, because the scope of application of the device in terms of handling articles of clothing of different sizes is thereby enlarged.

It is further an advantage if the part of the inflatable buck on which the shoulders of the article to be pressed come to rest is the same size as the shoulders of the largest article of clothing to be pressed and if the support on which the inflatable buck is mounted has the same dimensions in that region as the waist of the smallest article of clothing to be pressed. This is an advantage because it makes it easier to pull fastened, waist-fitting articles of clothing of different sizes onto the molded body of the device.

It is also an advantage if the shoulder region of the inflatable buck which is supported by the supporting elements is secured to the supporting elements by means of elements which are known per se, such as twine, in such a way that this region is displaceable with the supporting elements into a normal position and an operating position. This is an advantage because it also makes it easier to pull fastened, waist-fitting articles of clothing of different sizes onto the molded body of the device.

It is also an advantage if the inflatable buck is provided with double walls and if it is designed to be inflated by introducing pressurized air into the double-walled part of the same. This constitutes an advantage because it means that the supporting and spreading elements do not have to be disposed and controllably displaced in a chamber on which pressure is exerted by means of a pressure medium. This has a favorable effect on the susceptibility of the device to breakdowns and considerably reduces the air consumption of the same.

It is also an advantage if the inflatable buck is only inflated when the molded body has been advanced between the heated pressing plates, when the heated pressing plates have been brought to rest on the molded body and have been locked together in this position and when the supporting and spreading elements have been swung out as far as possible from the region of the support. This constitutes an advantage because it enables the susceptibility to breakdowns and the air consumption of the device to be further reduced. In addition, no friction is produced between the inflatable buck and the pressing plates during inflation of the inflatable buck.

It is also an advantage if, after inflation of the inflatable buck, externally heated elements such as heated metal rods are inserted in the gap remaining between the heated pressing plates until they come to rest against the inflated buck. This is an advantage because it enables the parts of the article to be pressed which do not come into contact with the pressing plates to obtain the same pressing effect or finish as the parts of the article which come into contact with the pressing plates.

It is also an advantage if the heated elements are displaceably mounted on one of the heated pressing plates. This constitutes an advantage because it eliminates the need for special fittings to mount these elements. This also has a favorable effect on the susceptibility of the device to breakdowns.

The device according to the invention for pressing articles of clothing which is characterized by the above features and, in particular by the combination of the feature consisting of "controllably displaceable supporting and spreading elements inside the inflatable buck for adapting the shape of the shoulders and/or side parts of the inflatable buck to the shape of the article to be pressed" and the feature consisting of "only inflating the inflatable buck when the molded body has been advanced between the heated pressing plates, when the heated pressing plates have been brought to rest on the molded body and locked together in this position and when the supporting and spreading elements have been swung out as far as possible from the region of the support, resp., the inflatable buck has been adapted as far as possible to the shape of the shoulders and/or side parts of the article to be pressed by means of the supporting and spreading elements," firstly makes it possible to press the body parts of fastened, waist-fitting articles of clothing such as shirts and work uniforms in a satisfactory manner. This is achieved in an especially economical manner if the inflatable buck is provided with double walls and is designed to be inflated by introducing pressurized air into the double-walled part of the same.

By virtue of the above-mentioned combination of the most important features of the invention, so-called steam channels are prevented from forming in the garment, particularly in the region of the shoulders and the side parts of the same, during the pressing operation.

The device according to the invention is also substantially better for pressing unfastened and/or fastened, waist-fitting articles of clothing than the device according to West German patent 1 123 650. This is due to the modus operandi resulting from the combination of the spreading elements and the inflatable buck.

By virtue of the afore-noted advantages, the device according to the invention can also be advantageously used for pressing the body parts of unfastened, non waist-fitting articles and, by means of known modifications, it can also be used for pressing sleeves, etc.

Other objects, features and advantages of the present invention will be made apparent in the following detailed description of various preferred embodiments thereof provided with reference to the accompanying drawings.

Figure 1:
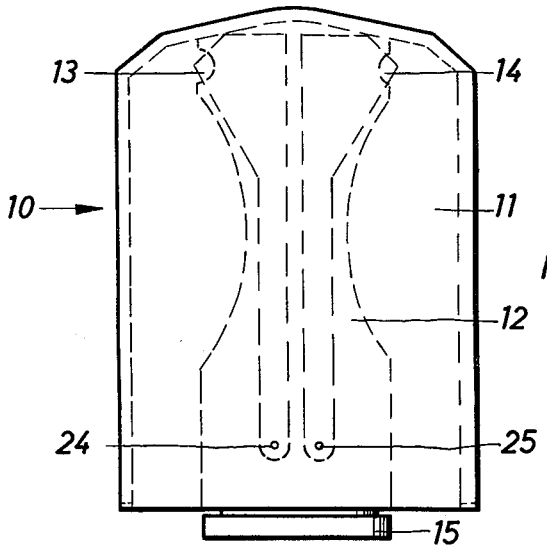
FIG. 1 shows a side view of a molded body according to the invention which is disposed on a frame and is designed for pressing the body parts of fastened, waist-fitting shirts, wherein the supporting elements for the shoulders of the sleeveless inflatable buck are in their normal position, resp., are inserted as far as possible in the support over which the sleeveless inflatable buck is mounted.

THE REFERENCE NUMBERS IN THE DRAWINGS DESIGNATE THE FOLLOWING:

10 = molded body (for pressing the body parts of shirts),
11 = inflatable buck (sleeveless)
12 = support
13, 14 = supporting elements (for the shoulders of item 11).
15 = frame,
16, 17 = pressing plates (heated),
18, 19 = elements (heated),
20, 21 = hinges,
22, 23 = arrows,
24, 25 = pivot axes (for items 13, 14),
26 = molded body for pressing the body parts of work uniforms),
27 = inflatable buck (sleeveless),
28 = support,
29, 30 = supporting elements for the shoulders of item 27),
31, 32 = spreading elements (for the side parts of item 27),
33 = frame,
34, 35 = pressing plates (heated),
36, 37 = pivot axes (of items 29, 30)
38, 39 = rods (for pivoting items 31, 32).

DESCRIPTION OF THE PREFERRED EMBODIMENTS

Figure 2:
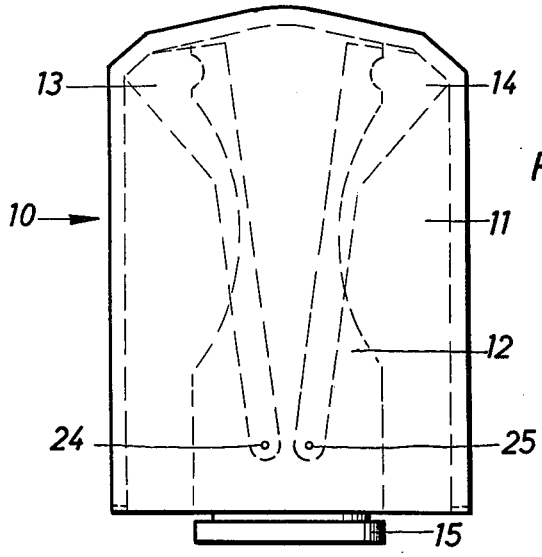
FIG. 2 shows a side view according to FIG. 1 but with the supporting elements for the shoulders of the sleeveless inflatable buck in a different position.
Figure 3:
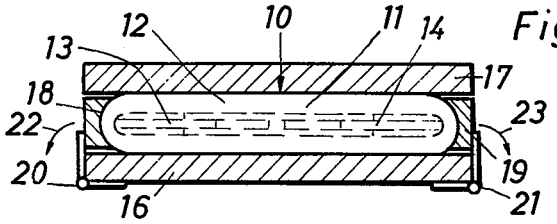
FIG. 3 is a plan view of FIG. 2 with two additional heated pressing plates represented in sectional form and with heated elements for the gap which is laterally disposed between the two pressing plates, displaceably mounted on said pressing plates.

The molded body 10 shown in FIGS. 1–3 which is disposed on the frame 15 and designed for pressing the body parts of fastened, waist-fitting shirts consists essentially of the support 12, on which a sleeveless inflatable buck 11 is mounted, and of the supporting elements 13, 14 for the shoulders of the inflatable buck 11. The supporting elements 13, 14 are disposed within the afore-noted parts.

The supporting elements 13, 14 for the shoulders of the inflatable buck 11 are mounted so that they can be advanced and retracted between the walls of the double-walled support 12 in such a way that in the retracted state (normal position) they are inserted as far as possible within the support 12 (FIG. 1). In the advanced state (working position) the upper edges of the supporting elements 13, 14 support the shoulders of the sleeveless inflatable buck 11 (FIG. 2).

The supporting elements 13, 14 are also so designed and mounted on the support 12 by way of the pivot axes 24, 25 in such a way that in the advanced state (working position) the upper edges of the elements 13, 14 conform to both the course of the shoulder line of the smallest shirt to be pressed and also to that of the largest shirt to be pressed and together with the sleeveless inflatable buck 11 they completely support the shoulders of these shirts. The shoulders of these shirts are thus supported according to their cut.

The advancement and retraction of the drive and supporting elements 13, 14 is effected by means of known drive elements which are not represented in FIGS. 1–3 and which are controlled by means of known elements (also not represented).

The frame 15 with the molded body 10 is adapted to be advanced and retracted between two heated pressing plates 16, 17 which are to be moved towards one another, by means of known elements which are not represented in the figures.

The pressing plate 16 comprises elements 18, 19 which are heated at least on their longitudinal sides. These elements 18, 19 are displaceably mounted on the plate 16 by way of the hinges 20, 21, for displacement in the direction of the arrow 22 or 23 and back.

The sleeveless inflatable buck 11 is provided with double walls and is adapted to be inflated by introducing pressurized air into the double-walled part of the buck 11 when the molded body 10 has been advanced between the heated pressing plates 16, 17, when the heated pressing plates 16, 17 have been brought to rest on the molded body 10 and the pressing plates 16, 17 locked together in this position and when the supporting elements 13, 14 have been moved into their outermost operating position.

The details of the double-walled configuration of the sleeveless inflatable buck 11 and of the devices for supplying pressurized air to the double walled-part of the same are not represented in FIGS. 1 – 3, as these are known or readily conceivable.

Figure 4:
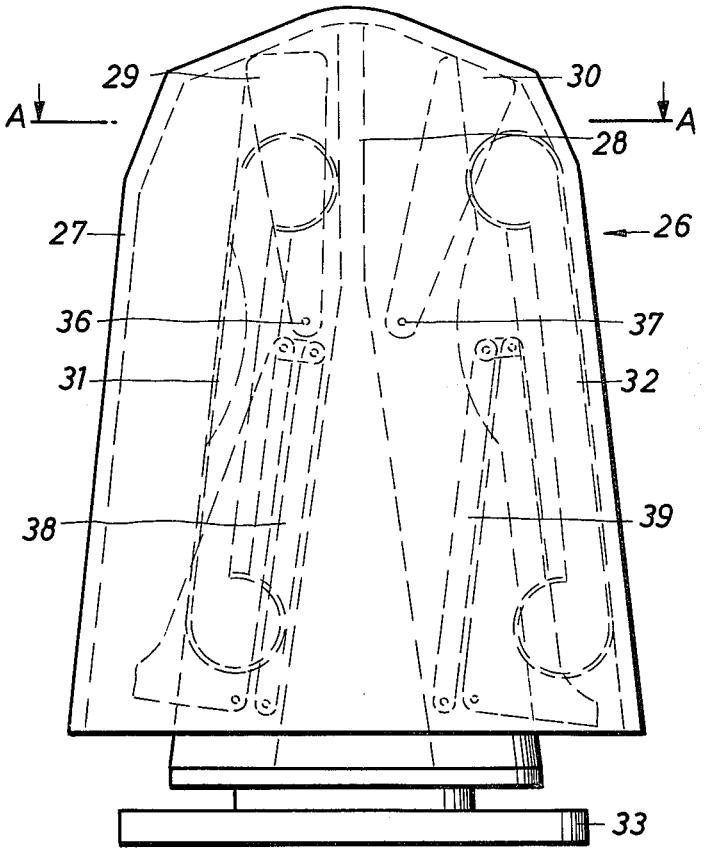
FIG. 4 is a sectional view through a molded body according to the invention which is disposed on a frame and designed for pressing the body parts of fastened, waist-fitting work uniforms, wherein part of the supporting and spreading elements for the sleeveless inflatable buck are represented in the normal position (left-hand side) and part are represented in the working position (righthand side).
Figure 5:
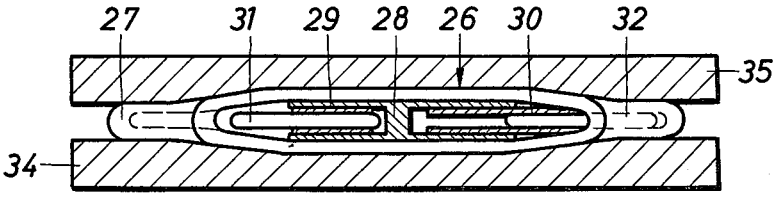
FIG. 5 shows a section through FIG. 4 along the line A—A with two additional heated pressing plates which are also represented in sectional form.

The molded body 26 represented in FIGS. 4 and 5 which is mounted on the frame 33 and designed for pressing the body parts of fastened, waist-fitting work uniforms consists essentially of the support 28, over which a sleeveless inflatable buck 27 is mounted, and the supporting and spreading elements 29, 30, 31, 32, which are intended for the shoulders and side parts of the inflatable buck 27 and which are disposed within the afore-noted parts.

The supporting elements 29, 30 for the shoulders of the inflatable buck 27 and the spreading elements 31, 32 which are provided for the side parts of the inflatable buck 27 and which are adapted to be partially inserted between the walls of the supporting elements 29, 30 are mounted for advancement and retraction between the walls of the double-walled support 28 in such a way that in the retracted state (normal position) they are inserted as far as possible within the support 28 (FIG. 4, lefthand side). In the advanced state (working position) the upper edges of the supporting elements 29, 30 support the shoulders of the sleeveless inflatable buck 27 and the spreading elements 31, 32 spread the side parts of the same (FIG. 4, righthand side).

The frame 33 with the molded body 26 is also adapted to be moved in and out by means of known elements which are not represented in FIGS. 4 and 5 between two heated pressing plates 34, 34 adapted to be moved towards one another (FIG. 5).

It is an advantage if the shoulder region of the inflatable buck 11 or 27 which is supported by the supporting elements 13, 14 or 29, 30 is secured to the supporting elements 13, 14 or 29, 30 by means of elements which are known per se, such as twine, in such a way that this region may be displaced with the supporting elements 13, 14 or 29, 30 into a normal position and a working position. This feature of the device is not represented in the drawings.

It is also advantageous — although this is not represented in the figures—to provide flexible bracing means such as fillets or expanded rubber profile bars provided with springs on the front and rear sides of the supports 12, 28 such that when the heated pressing plates 16, 17 or 34, 35 are brought to rest on the molded body 10 or 26, they rest against these bracing elements with the part of the sleeveless inflatable buck 11 or 27 located at this point, inserted therebetween.

The method of operation of the devices represented in FIGS. 1–5 is the following:

For the purpose of pulling the article of clothing (shirt or work uniform) to be pressed, which is not represented, onto the molded body 10 or 26, the supporting and spreading elements 13, 14 or 29, 32 of the same are moved into the normal position. When this has taken place, the article of clothing is pulled manually from above over the sleeveless inflatable buck 11 or 27 which is not inflated at this point. The supporting and spreading elements 13, 14 or 29–32 are then mechanically swung out of the region of the support 12 or 28 until they come to rest on the article of clothing — with the sleeveless inflatable buck 11 inserted therebetween — and thus stretch the article to be pressed according to its cut.

The stretching of the article according to its cut can be effected simultaneously with the manual arranging of the collar and/or of the button band of the article to be pressed.

When the article has been stressed according to its cut and its collar and/or button band have been arranged, the frame 15 or 33 with the molded body 10 or 26 is displaced in such a way that the molded body 10 or 26 comes to rest between the heated pressing plates 16, 17 or 34, 35 which are spaced apart from each other. When this has taken place, the heated pressing plates 16, 17 or 34, 35 are brought to rest on the molded body 10 or 26 and are locked together in this position. The supporting and spreading elements 13, 14 or 29–32 are then extended as far as possible from the support 12 or 28 and, as a result, the article of clothing to be pressed which has been pulled onto the molded body 10 or 26 and already prestressed and arranged, is then fully stretched. When this operation is terminated, the sleeveless inflatable buck 11 or 27 is inflated, whereupon the major part of the body portion of the article to be pressed comes into contact with the heated pressing plates 16, 17 or 34, 35 and is thus pressed.

If heated elements 18, 19 for insertion in the gap remaining between these heated plates 16, 17 after the same have been pressed against the molded body, are disposed on the edges of the heated pressing plates 16, 17 (FIG. 3), these are inserted in the gap provided for the same prior to, during or after the inflation of the sleeveless inflatable buck 11. After the pressing operation these heated elements 18, 19 are again removed from the gap.

Upon termination of the pressing operation, the heated pressing plates 16, 17 or 34, 35 are unlocked, the air is evacuated from the sleeveless inflatable buck 11 or 27 and the pressure is removed from the supporting and spreading elements 13, 14 or 29–32. When this has been effected, the frame 15 or 33 with the molded body 10 or 26 is moved back into the servicing station and the pressed article (shirt or work uniform) is there removed manually from the sleeveless inflatable buck 11 or 27. If necessary, this is only effected after the supporting and spreading elements 13, 14 or 29–32 have been returned fully to their normal position.

If the articles to be pressed have long sleeves, these sleeves are clamped during the operation of pressing the body portion of the articles by means of known clamping devices disposed on the frame 15 or 33. These devices are not represented in the drawings.

The long sleeves can be pressed on known sleeve pressing devices or on devices constructed according to the invention.

What is claimed is:

1. A device for pressing articles of clothing, more particularly, for pressing the body parts of shirts and work uniforms having at least two heated pressing plates comprising: a) a support; b) a molded body mounted on the support and consisting of an inflatable buck or the like made of a pressure medium-resistant material; c) means to advance and retract the inflatable buck between the heated pressing plates; and d) controllably movable supporting and spreading elements (13, 14 or 29–32) attached to said support and located inside the inflatable buck, said elements movable to fully support the contours of the shoulders and/or side parts of the inflatable buck (11 or 27) against the contours of the article to be pressed.

2. A device as claimed in claim 1, wherein the support has at least two walls and the controllably movable supporting and spreading elements (13, 14 or 29–32) are attached thereto for advancement and retraction between the walls of the support (12 or 28), in such a way that in the retracted state (normal position), they do not protrude beyond the lateral edges of the support walls.

3. A device as claimed in claim 1 wherein the supporting elements (29, 30) for adapting the contours of the shoulders of the inflatable buck (27) to those of the article of clothing to be pressed are provided with double walls and the spreading elements (31, 32) for adapting the contours of the side parts of the inflatable buck (27) to those of the article to be pressed are advanced and retracted at least partially between the walls of the support (29, 30).

4. A device as claimed in claim 1 wherein the part of the inflatable buck (11, 27) on which the shoulders of the article to be pressed come to rest is the same size as the shoulders of the largest article of clothing to be pressed and the support (12 or 28) over which the inflatable buck (11 or 27 is mounted) has the same dimensions in that region as the smallest article of clothing to be pressed.

5. A device as claimed in claim 1 further comprising means to attach the shoulder region of the inflatable buck (11 or 27) which is supported by the supporting elements (13, 14 or 29, 30) to the supporting elements (13, 14 or 29, 30) in such a way that this region is displaceable with the supporting elements (13, 14 or 29, 30) into a retracted position and an advanced position.

6. A device as claimed in claim 1 wherein the inflatable buck (11 or 27) is made from double walled material and is inflated by introducing pressurized air between the double-walls of same.

7. A device as claimed in claim 1 wherein the inflatable buck (11, 27) is inflated after the molded body (10 or 26) has been advanced between the heated pressing plates (16, 17 or 34, 35), after the heated pressing plates (16, 17 or 34, 35) have been brought to rest on the molded body (10 or 26) and locked together in this position and after the supporting and spreading elements (13, 14 or 29–32) have been swung out as far as possible from the region of the support (12 or 28).

8. A device as claimed in claim 7, wherein after the inflatable buck (11) has been inflated, externally heated elements (18, 19), are inserted in the gap remaining between the heated pressing plates (16, 17) until they come into contact with the inflated buck (11).

9. A device as claimed in claim 8, wherein the heated elements (18, 19) are displaceably mounted on one of the heated pressing plates (16, 17).

* * * * *